US005911762A

United States Patent [19]

Ott

[11] Patent Number: 5,911,762

[45] Date of Patent: Jun. 15, 1999

[54] ANTI-THEFT DEVICE

[76] Inventor: Reinhold Ott, Europaplatz 20, D-70565 Stuttgart, Germany

[21] Appl. No.: 08/882,925

[22] Filed: Jun. 26, 1997

Related U.S. Application Data

[63] Continuation of application No. PCT/EP95/05076, Dec. 21, 1995.

[30] Foreign Application Priority Data

Dec. 29, 1994 [DE] Germany ..... 94 20 833 U
Apr. 28, 1995 [DE] Germany ..... 195 15 660

[51] Int. Cl.[6] ..... E05B 69/00

[52] U.S. Cl. ..... 70/58; 208/224.61; 211/26.1; 403/326

[58] Field of Search ..... 70/14, 58; 292/DIG. 38; 403/326, 331, 381; 248/551–553, 224.61, 224.7, 205.2; 211/4, 26.1, 69.1

[56] References Cited

U.S. PATENT DOCUMENTS

| | | | |
|---|---|---|---|
| 2,644,475 | 7/1953 | Morton | 403/326 X |
| 2,732,159 | 1/1956 | Connors et al. | 248/224.61 X |
| 2,783,701 | 3/1957 | Padeick | 403/326 X |
| 2,889,451 | 6/1959 | Congo | 248/224.61 X |
| 3,369,265 | 2/1968 | Halberstadt et al. | 403/326 X |
| 3,545,798 | 12/1970 | Swett | 403/326 |
| 3,602,562 | 8/1971 | Radelfinger | 312/119 |
| 4,212,175 | 7/1980 | Zakow | 70/58 |
| 4,480,450 | 11/1984 | Brown | 70/10 |
| 4,504,168 | 3/1985 | Miller | 403/331 X |
| 4,684,285 | 8/1987 | Cable | 403/331 |
| 4,694,965 | 9/1987 | Parnell | 248/224.61 X |
| 4,781,487 | 11/1988 | Greco | 403/326 |
| 4,817,402 | 4/1989 | Lelding | 70/58 |
| 4,867,598 | 9/1989 | Winter, IV | 403/331 X |
| 4,989,815 | 2/1991 | McAuley | 248/224.61 |
| 5,244,300 | 9/1993 | Perreira et al. | 403/331 X |
| 5,316,249 | 5/1994 | Anderson | 211/26.1 X |
| 5,398,366 | 3/1995 | Bradley | 403/381 X |
| 5,438,911 | 8/1995 | Fiedler et al. | 403/381 X |
| 5,500,958 | 3/1996 | Falco | 403/331 X |
| 5,692,722 | 12/1997 | Lundagards | 70/58 X |

FOREIGN PATENT DOCUMENTS

| | | |
|---|---|---|
| 2 339 373 | 8/1977 | France . |
| 89 07 641 | 9/1989 | Germany . |
| 279988 | 12/1927 | United Kingdom . |
| WO 85/03735 | 5/1985 | WIPO . |

*Primary Examiner*—Steven Meyers
*Attorney, Agent, or Firm*—Barry R. Lipsitz; Ralph F. Hoppin

[57] ABSTRACT

A device for mechanically securing an article against theft is suggested, wherein the device comprises a first holding component with a securing surface for securing to an object, a second holding component for securing to the article, a cable connecting the two holding components and connecting components respectively associated with the holding components and having undercut sections for providing a releasable, form-locking holding connection of the two holding components. A very simple handling of the device is achieved by the fact that at least one of the connecting components comprises an undercut section with a mating surface inclined in relation to the securing surface such that the holding connection can be released by means of a releasing force acting at right angles to the securing surface.

15 Claims, 3 Drawing Sheets

ANTI-THEFT DEVICE

This application is a continuation of PCT/EP95/05076, filed Dec. 21, 1995.

BACKGROUND OF THE INVENTION

The present invention relates to a device for mechanically securing an article against theft, wherein the device comprises a first holding component with a securing surface for securing to an object, a second holding component for securing to the article, a cable connecting the two holding components and connecting components respectively associated with the holding components and having undercut sections for providing a releasable, form-locking holding connection of the two holding components.

Securing devices of this type are used, above all, in stores selling radio and television equipment, video equipment, telephone systems or the like, in which a large number of demonstration models are kept ready for operation and trial use by customers. In order to avoid losses of devices or, in particular, remote control devices associated with them, the smaller devices or the remote control devices are secured to an object, such as a display shelf or a large, unwieldy device, with the specified devices. The cable connecting the two holding components allows a trial use of the secured device or the secured article by the customer. The connection to the object makes it difficult to steal the article.

The connecting components provided on the securing device allow the provision of a holding connection between the two holding components. In this way it is possible to connect the secured article releasably to the associated object for an attractive presentation.

A device for mechanically securing an article against theft with the features specified at the outset is known, in which two holding components are connected with one another via a thin plastic cable. Connecting components are arranged on the side of the holding components facing away from the object or the article to be secured and these are formed, on the one hand, by a web with a dovetailed cross section and, on the other hand, by a complementary groove open at an end face. In order to provide the holding connection between the holding components, the web-like connecting component can be inserted longitudinally into the recess and parallel to a securing surface of the holding component to be secured on the object.

In this respect, it is disadvantageous that the provision of the holding connection requires a relatively exact introduction of the web-like connecting component into the recess. Furthermore, it must be taken into consideration that the entire device is often covered by the article to be secured when the holding connection is established. This results in the additional disadvantage that a customer, for releasing the holding connection, in particular when the first holding component is secured to a vertically extending surface of an object, attempts to pick up the article with a force directed away from the surface of the object, whereby the first holding component which is customarily adhered firmly to the object is torn away from the object very easily. Accordingly, the known device does not withstand frequent use.

In addition, a device for mechanically securing an article against theft is known, in which the two holding components are connected to one another via a thin steel strand. The device has connecting means for providing a releasable holding connection which is formed by so-called Velcro strip fasteners which are respectively arranged on the sides of the holding components facing away from the object or the article to be secured.

This results in the disadvantages that a release of the Velcro strip connection between the holding components requires a considerable releasing force which can lead, with frequent usage of the device, to impairment of the connection between the holding component and the article to be secured or the object, and that the Velcro strip fasteners do not predetermine any defined relative position of the two holding elements in their connected state relative to one another, whereby the provision of a proper holding connection between the holding components presents the customer, in particular, with difficulties which can lead to damage to the secured article due to an undesired release of the holding connection. Moreover, the Velcro strip connection cannot be subjected to any great loads.

SUMMARY OF THE INVENTION

The object underlying the invention is to create a device for mechanically securing an article against theft which makes a particularly simple handling and the provision of a secure holding connection possible.

This object is accomplished in accordance with the invention, in a device with the features specified at the outset, in that at least one of the connecting components comprises an undercut section with a mating surface inclined in relation to the securing surface such that the holding connection can be released by means of a releasing force acting at right angles to the securing surface.

On account of the inventive configuration it is possible to secure the first holding component to a vertically extending surface of an object such that the relative movement of the second holding component in relation to the first which is required for releasing the holding connection proceeds at an angle upwards in relation to the horizontal. Accordingly, the weight force of the second holding component and an article held by this counteracts any undesired releasing of the holding connection between the holding components since the weight force causes a force component directed opposite to the releasing movement on account of the inclined mating surface. Furthermore, this arrangement complies with the intuitive behavior of the customer to move the article away from the object directly towards him or herself. The inventive solution leads, namely, to the fact that in the case of a releasing force acting on the second holding component in the direction of the surface normal of the securing surface of the first holding component, i.e. in the case of a releasing force directed away from the object, a force component results in the direction of the inclination of the mating surface which leads to a releasing movement of the second holding component in relation to the first which proceeds in this direction. Accordingly, a very simple release of the holding connection results, even when the entire device is covered by the article to be secured when the holding connection to the object is established.

In a preferred development, the angle of inclination formed by the mating surface and the securing surface is 25 to 60°. This results in a good securing against any undesired release of the holding connection when, for example, a customer inadvertently knocks an article held by the securing device, and, in addition, a relatively easy release of the holding connection is made possible with this range of inclination, wherein the connection of the first holding component to the object is not overloaded.

A particularly preferred embodiment is characterized in that the undercut sections are each arranged at edge regions of the connecting components such that the holding connection can be provided by way of a relative movement of the holding components proceeding essentially parallel to the securing surface. This results in a very simple provision of the holding connection in that the second component can be suspended on the first holding component due to a movement proceeding essentially parallel to the surface of the object. In addition, the holding connection can be released not only in the direction of the inclination of the mating surface but also contrary to the specified suspending direction and so the release of the holding connection is also simplified.

A holding connection which can be subjected to very high loads results when one of the connecting components comprises two undercut mating surfaces, the planes of which have straight tracks in the plane of the securing surface, these tracks extending at an angle to one another. In the case of an approximately vertical alignment of the angle bisectors between the straight tracks, a holding connection which can be subjected to quite considerable tilting moments is made possible, wherein the two connecting components engage behind one another, in particular, over the entire longitudinal extension of the mating surfaces.

In one variation, the V shape is modified by the fact that this is flattened in the region of its tip so that three undercut mating surfaces are formed. This means that sharp corners and edges are largely avoided and so there is no risk of injury even in the case of a protruding design.

A particularly preferred variation of the embodiment provides, in this respect, for the two mating surfaces to be arranged in a V shape relative to one another. The mating surfaces thus form for the connecting component, which is of a complementary design thereto, an inclined insertion surface which further facilitates the provision of the holding connection.

The angle of intersection of the straight tracks is preferably 50 to 80°. This leads to a holding connection between the holding components which is very stable with respect to tilting but also easily releasable.

A particularly simple production of the device results when the connecting components are each designed in one piece with the holding components. Alternatively, the connecting components can, however, also be produced separately from the holding components and subsequently arranged on the latter.

A particularly preferred construction is characterized by the fact that the connecting components are designed essentially rigid. This results in a particularly high loading capacity of the holding connection, apart from a simple production, since the connecting components do not yield. In addition, a very long service life of the device results even with frequent use thereof since there is no fatigue of, for example, sections elastically deformed during the provision and release of the holding connection.

Due to the fact that the second holding component comprises a securing surface for securing to the article and the securing surfaces of the two holding components are parallel and facing away from one another when the holding connection is established, it is possible for the surfaces of the article and the object, to which the holding components are secured by means of the securing surfaces, to always extend parallel to one another when the holding connection is provided. This results in a uniform alignment of the secured article when the holding connection is established. This is conducive to an attractive presentation of the article.

A further design alternative results when the connecting components are designed such that the holding components can be locked with one another. This can, for example, be realized when the connecting parts comprise at least one resilient, undercut section. The locked holding component results in the advantage that any undesired release of the holding connection when, for example, a customer knocks the secured article by mistake can largely be avoided. Thus, the frequency of damage to the articles is reduced.

In a further design variation it is provided for a connecting component to comprise edge sections which engage over the other connecting component on several sides with lateral clearance when the holding connection is established. This makes it possible to provide a holding connection between the connecting components even in the case of different rotary positions of the securing device. The lateral clearance is necessary in order to make an easy provision and release of the holding connection possible with respect to the undercut sections.

The invention will be explained in greater detail in the following on the basis of the drawings of three embodiments.

DETAILED DESCRIPTION OF THE INVENTION

Figure 1:
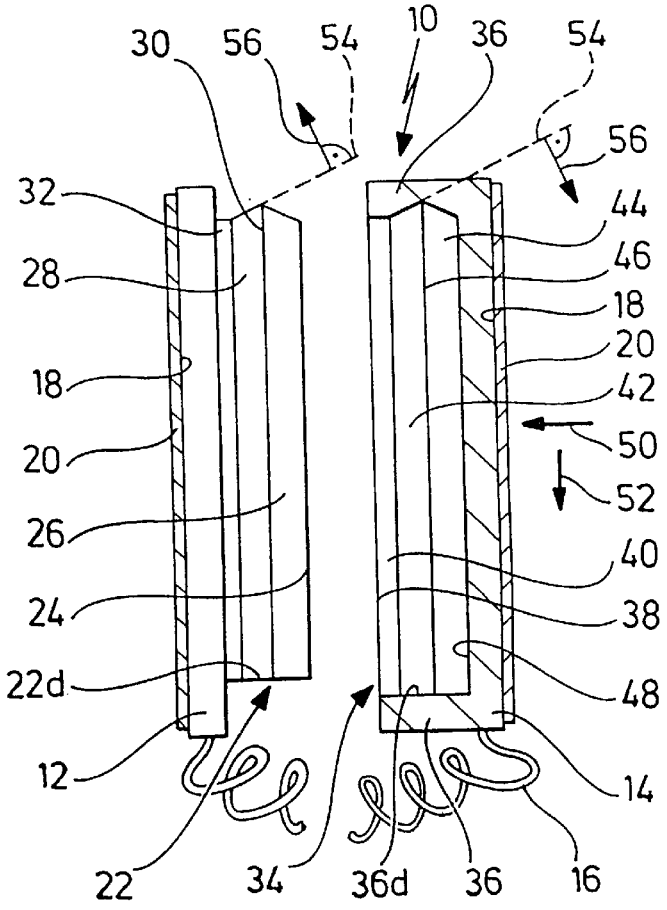
FIG. 1 a lateral view of a first embodiment of a securing device when the holding connection is released with a sectional illustration of a second holding component.

FIG. 1 shows an inventive device 10 for mechanically securing an article which is not illustrated against theft. The device 10 comprises a first holding component 12 and a second holding component 14 which are connected to one another with a cable 16 in the form of a flexible, partially helical plastic cable.

Figure 2:
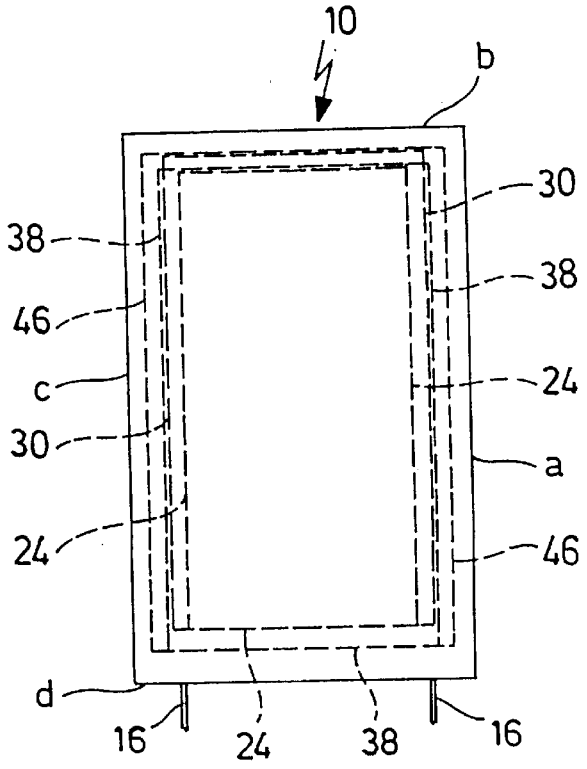
FIG. 2 a plan view of the device according to FIG. 1 when the holding connection is provided.

It is apparent from the plan view according to FIG. 2 that the two holding components 12 and 14 each have essentially the shape of a flat parallelepiped.

The first holding component 12 is provided for securing to an object, such as a larger device, a shelf for articles or the like. For this purpose, the first holding component 12 comprises on a flat side a securing surface 18, to which an adhesive layer 20 is adhered, as is apparent from FIG. 1.

The second holding component 14 likewise has on a flat side a securing surface 18 with an adhesive layer 20 which serves to attach an article to be secured, which is not illustrated.

In the embodiment, the adhesive layer 20 is formed each time by a double-sided adhesive tape.

The first holding component 12 has a first connecting component 22 on its flat side facing away from the securing surface 18. This connecting component is designed in one piece with the holding component 12.

The first connecting component 22 has essentially the shape of a flat parallelepiped, wherein the connecting component 22 merges at a flat side into the first holding component 12.

Since, in the illustrated embodiment, not only the first holding component 12, the second holding component 14 but also the first connecting component 22 are each designed essentially in the shape of a flat parallelepiped, the narrow sides of the parallelepiped shape are uniformly designated as a, b, c and d, wherein a and c designate the respective longitudinal sides and b and d the respective end sides of the parallelepiped, as is apparent from FIG. 2.

The first connecting component 22 is arranged with its sides a to d so as to extend parallel to the corresponding sides of the first holding component 12. Proceeding from the surrounding edge 24 of the flat side of the connecting component 22 facing away from the first holding component 12, the connecting component has an inclined insertion surface 26 at its sides a, b and c and so the connecting component 22 widens at the sides a, b and c in the direction of the holding component 12 in the shape of a truncated pyramid. The three sides a, b and c of the connecting component 22 are adjoined by an undercut section 28 which forms a common edge 30 with the inclined insertion surface 26 at the sides a, b and c. The undercut section is adjoined as far as the first holding component 12 by a straight section 32 with a constant, rectangular cross section. The inclined insertion surface 26 as well as the sections 28 and 32 are formed at each of the sides a, b and c by plane surface sections. The end side 22*d* of the first connecting component 22 facing the connecting cable 16 extends at right angles to the securing surface 18 of the first holding component 12.

The second holding component 14 has a second connecting component 34 which, in the illustrated embodiment, is formed by a recess on the side of the second holding component 14 facing away from the securing surface 18, this recess having the shape of a flat parallelepiped. This parallelepiped-shaped recess and thus the second connecting component 34 is designed essentially complementary to the first connecting component 22. The sides a to d of the parallelepiped shape again extend parallel to the corresponding sides of the parallelepiped formed by the second holding component 14.

The second connecting component 34 comprises an edge section 36 which limits the formed recess on all sides a to d. The edge section 36 has an inner surrounding edge 38 at the free end facing away from the securing surface 18 of the holding component 14. Proceeding from this edge 38, the edge section 36 has a straight wall section 40 at its inner wall on all sides a to d which extends at right angles to the securing surface 18. This is adjoined by an undercut section 42 which is formed at the sides a, b and c of the inner wall of the edge section 36 or of the second connecting component 34. This undercut section 42 corresponds in its inclination and extension essentially to the undercut section 28 of the first connecting component 22. The undercut section 42 leads to an increase in the size of the interior cross section in the direction towards the securing surface 18 of the second holding component 14.

The undercut section 42 is followed by an inclined section 44 which has an oppositely directed inclination and is formed accordingly at the sides a, b and c. The sections 42 and 44 have a common edge 46 at the sides a, b and c. With its oppositely located edge, the section 44 merges into the base 48 of the recess formed by the second connecting component 34. This extends parallel to the securing surface 18 of the holding component 14.

The inner side 36*d* of the edge section 36 adjacent the cable 16 is designed in accordance with the end side 22*d* of the first connecting component 22 so as to be plane and extend vertically to the securing surface 18.

In the illustrated embodiment, the undercut sections 28, 42 as well as the inclined insertion surface 26 and the section 44 are each inclined essentially at the same angle. However, different inclinations which can, in addition, vary as a function of the sides a, b, c can also be provided.

In the following, the mutual fitting of the two connecting components 22 and 34 will be explained on the basis of FIGS. 1 and 2. FIG. 2 shows a plan view of the second holding component 14 connected to the first holding component 12. In this respect, the edges of the two connecting components 22 and 34 which are essential for the spatial fitting are illustrated by dashed lines. The provision of the connection will be explained in detail later.

The edge 30 extending over the three sides a, b and c of the first connecting component 22 forms, together with the end side 22*d*, the largest cross section of the protruding first connecting component 22. In contrast thereto, the second connecting component 22 has a minimum interior cross section increased in size by a slight clearance in the region of the edge 38 of the edge section 36 and in the region of the wall section 40. Since, in addition, the depth of the recess formed by the second connecting component 34 is adjusted to the height of the protruding first connecting component 22, i.e. the two connecting components 22 and 34 correspond to one another in their respective extension at right angles to the securing surfaces 18, it is possible to insert the first connecting component 22 completely into the second connecting component 34.

The provision of the holding connection between the two holding components 12 and 14, i.e. the arrangement of an article to be secured, which is attached to the second holding component 14 by means of the adhesive layer 20, on an object bearing the first holding component 12 by means of the associated adhesive layer 20, is carried out by a movement in the direction of arrow 50 which proceeds essentially at right angles to the securing surfaces 18. In this respect, the two securing surfaces 18 and thus the two holding components 12 and 14 are aligned essentially parallel to one another. When the second holding component 14 is moved towards the first holding component 12, an automatic centering or relative alignment of the second holding component 14 with respect to the first holding component 12 takes place as a result of the inclined insertion surface 26 of the first connecting component 22 and the edge 38 of the second connecting component 34 abutting thereon. When the holding component 14 is moved closer to the holding component 12, the straight section 40 of the second connecting component 34 slides over the edge 30 and the end side 22*d* of the first connecting component 22. Since a certain clearance is present between the two connecting components 22 and 34, the provision of the holding connection is carried out smoothly. Finally, the free end of the edge section 36 of the second connecting component 34 abuts on the first holding component 12 and limits the movement in the direction of arrow 50.

In the following, the case which frequently occurs of the first connecting component 12 being adhered to a vertically extending surface of the object, which is not illustrated, with its adhesive layer 20 and thereby aligned such that the side b is located at the top and extends horizontally will be described.

Once the two holding components 12 and 14 have been joined together, as described in the above, such that the edge section 36 of the second connecting component 34 engages over the protruding first connecting component 22 on all sides, the weight force causes a displacement of the second holding component 14 in relation to the first holding component 12 downwards in accordance with arrow 52. This results in the undercut sections 28 and 42 engaging behind one another in the region of the upper side b and the side b of the inner wall formed by the edge section 36 coming to rest on the end side b of the first connecting component 22. This results in a form-locking connection between the two holding components 12 and 14 which can also be subjected to considerable loads on account of the rigid design of the two connecting components 22 and 34. This means that the second holding component 14 is suspended on the first. The engagement of the two undercut sections 28 and 42 behind one another prevents the second connecting component 34 from sliding off the first connecting component 22 contrary to the direction of arrow 50. A secure holding connection between the two holding components 12 and 14 thus results which is secured against any undesired releasing.

An essential idea of the invention is to be seen in the fact that the undercut section 28 and the undercut section 42 each form a mating surface 54 which extends at an angle to the direction of arrow 50, i.e. at an angle to the direction of movement for providing the holding connection, and has a surface normal 56 with a vertical component in the region of the upper side b. This alignment of the two undercut mating surfaces 54 allows the engagement behind one another to be released essentially by means of a releasing movement of the second holding component 14 contrary to the direction of arrow 50. The alignment of the two mating surfaces 54 provided in the embodiment leads, when a force is applied contrary to the direction of arrow 50, to a releasing movement with a slight, vertical component which leads to the engagement of the undercut sections 28 and 42 behind one another being overcome. This results, for the customer, in a simple release of the secured article from the holding connection with the first holding component 12 on the object in that the customer merely applies a releasing force directed towards himself or away from the surface of the associated object. The weight force of the secured article and the second holding component 14 counteracts the downward movement during the release of the holding connection and so any unintentional release is prevented and thus any inadvertent damage to an article secured on the second holding component 14 is largely avoided.

FIG. 2 shows the two holding components 12 and 14 when the holding connection is established, wherein the holding component 12 is secured to a vertically extending surface with vertically aligned longitudinal sides a and c. Accordingly, the second holding component 14 is suspended with its end side b of the second connecting component 34 on the first connecting component 22 of the first holding component 12 at the top. The connecting cable 16 is thereby secured to the respective lower end sides d of the two holding components 12 and 14 and hangs down in an approximately semicircular arc.

Corresponding to the case described of the vertical attachment with vertical alignment of the longitudinal sides a and c of the inventive device 10, it is also possible with the embodiment described to secure the holding component 12 with horizontally aligned longitudinal sides a and c on a surface of the object which is not illustrated extending essentially vertically or also at an angle. This may, for example, be necessary when the object has a very flat housing, the vertical sides of which have a vertical extension which is considerably less than the longitudinal extension of the first holding component 12. In this case, a horizontally extending arrangement of the first holding component 12 on the object is recommended.

Due to the fact that the undercut sections 28 and 42 are provided in this case on the sides a, b and c of the two connecting components 22 and 34 which are at an angle in relation to one another, a holding connection such as that in the case already described in the above with a corresponding provision and release of the connection also results with a transversely extending alignment of the longitudinal sides a and c, wherein one of the longitudinal sides a, c can be optionally arranged at the top, in the state secured on the object. The only difference is that the undercut sections 28 and 42 engage with one another in the region of the longitudinal side a or c respectively located at the top. The same cycles of movement and the same advantages also result, i.e. always a secure holding connection which is simple to establish and can also be easily released again, as in the alignment described at the outset.

In addition, it goes without saying that, apart from an attachment to vertically extending surfaces of the object, the holding component 12 can also be attached to inclined or horizontally extending surfaces. In any case, a secure holding connection between the two holding components can be provided.

With the exception of a horizontal alignment at the top of the end side d of the holding component 12 facing the connecting cable 16, the illustrated embodiment 10 can thus be secured with its holding component 12 in any optional alignment on the object and can thus be used universally. When required, the side b can, for example, also have the undercut sections 28, 42 so that even with a horizontal alignment of this side at the top a secure holding connection can be provided between the holding components 12 and 14.

On account of the preferably rigid design of the connecting components 22 and 34, a long service life of the inventive device 10 results even with frequent use thereof. Furthermore, when releasing the holding connection between the two holding components 12 and 14 a relatively slight releasing force is required and so the adhesive connections provided by means of the adhesive layer 20 between the first holding component 12 and the object as well as the second holding component 14 and the article to be secured are subject to little load and thus very durable.

Figure 3:
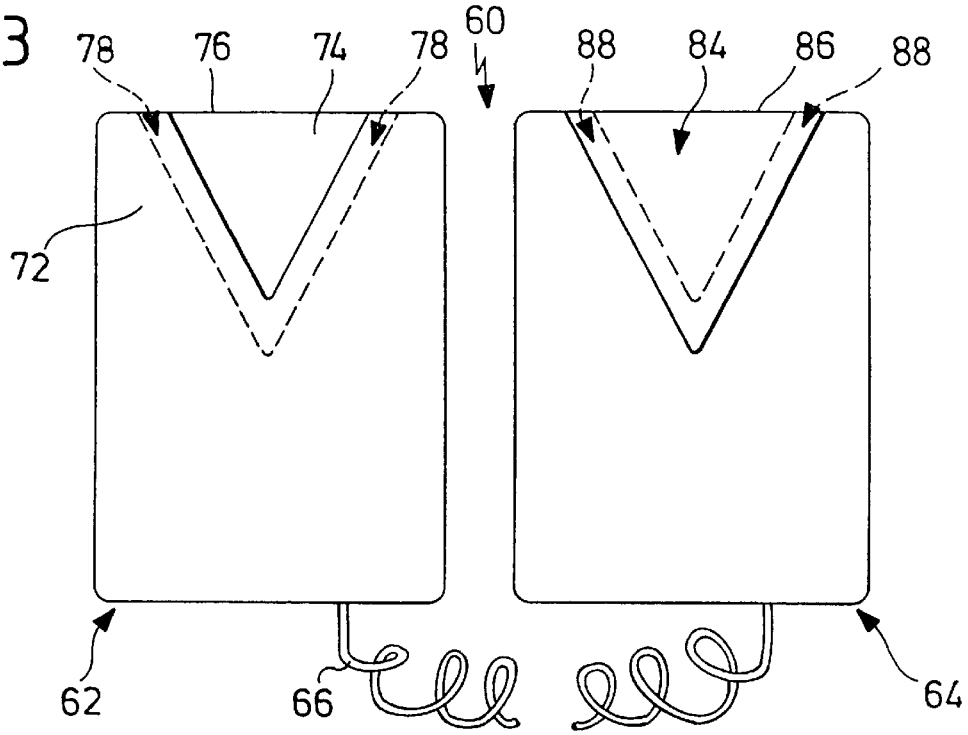
FIG. 3 a lateral view of a second embodiment of a securing device with separated holding components.
Figure 4:
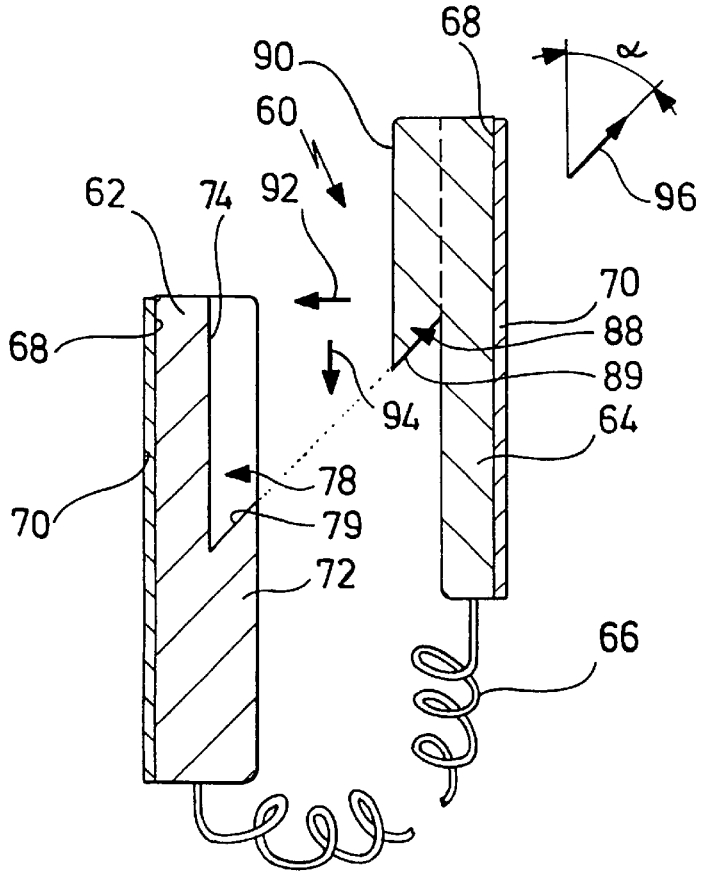
FIG. 4 a sectional illustration of the device according to FIG. 3 with holding components located opposite one another.

FIGS. 3 and 4 show a second embodiment of an inventive device 60 for mechanically securing an article which is not illustrated against theft. The device 60 again comprises a first holding component 62 and a second holding component 64 which are connected with a flexible cable 66.

As in the first embodiment, the holding components 62 and 64 each have essentially the shape of a flat parallelepiped, wherein the first holding component 62 is provided for securing to an object and has for this purpose on a flat side a securing surface 68 with an adhesive layer 70 adhered thereto. The second holding component 64 likewise has on a flat side a securing surface 68 with an adhesive layer 70 which serves to attach an article to be secured which is not illustrated.

In this case, as well, both adhesive layers 70 are formed by an adhesive tape adhesive on both sides.

The first holding component 62 has on its flat side facing away from the securing surface 68 a first connecting component 72 which is formed in one piece with the holding component 62.

The connecting component 72 is plate-like in design and has essentially the same, flat parallelepiped shape as the first holding component 62. The first connecting component 72 has a recess 74 which corresponds essentially to the flat frustum of a three-sided, irregular pyramid, the base surface of which faces the flat side of the first holding component 62. The recess 74 is arranged at the side edge of the connecting component 72, namely at an end face 76 which is located opposite the point of attachment of the cable 66 on the first holding component 62. The end surface of the truncated pyramid is located in the flat side of the first connecting component 72 facing away from the first holding component 62 so that the connecting component 72 limits the recess 74 by means of two undercut sections 78 which form mating surfaces 79 extending in a V shape relative to one another and inclined in relation to the flat side.

The second holding component 64 has on its flat side located opposite the securing surface 68 a second connecting component 84 which is connected in one piece with it and is designed as a flat frustum of an irregular, three-sided pyramid which is connected at its end face with the flat side of the second holding component 64. The second connecting component 84 is designed essentially complementary to the first connecting component 72, i.e. corresponds approximately in its shape to the recess 74. Furthermore, the second connecting component 84 is arranged on the second holding component 64 corresponding to the recess 74 on the first holding component 62, the protruding second connecting component 84 thus extends, proceeding from an end face 86 of the second holding component 64 which is located opposite a securing point of the cable 66 on the second holding component 64, towards the center of the flat side of the second holding component 64 with side surfaces running towards one another in a V shape. These side surfaces represent undercut sections 88 which form mating surfaces 89 inclined in relation to the flat side of the second holding component 64 and thus also to its securing surface 68.

The holding components 62 and 64 with their respective connecting components 72 and 84 are each extruded in one piece from plastic and so a simple production of the device 60 is made possible.

Since not only the connecting components 72 and 84 but also the holding components 62 and 64 are of a rigid design, no wear and tear results during use of the device 60, and the service life of the device 60 is, as it were, unlimited.

The use of the inventive device 60 will be described in the following.

In the embodiment, the first holding component 62 is adhered by means of its adhesive layer 70 to a surface of an object extending at an angle to the horizontal or vertically in order to secure the first holding component 62 on the object. In this respect, the first holding component 62 is aligned such that the recess 74 is located at the top and the end face 76 of the first holding component 62 associated with the recess 74 extends essentially horizontally.

The second holding component 64 is connected by means of its adhesive layer 70 with an article to be secured which is not illustrated.

To provide the holding connection between the holding components 62 and 64, the second holding component 64 is suspended with its second connecting component 84 in the recess 74 formed by the first connecting component 72. For this purpose, the second holding component 64 is moved towards the first connecting component 72 with its second connecting component 84 in front and with its flat sides aligned approximately parallel to the first holding component 62 until the second connecting component 84 meets the first holding component 62 in the region of the recess 74 with its end face 90 facing away from the second holding component 64. This relative movement between the two holding components 62 and 64 takes place essentially at right angles to the two securing surfaces 18 of the holding components 62 and 64, which are held approximately parallel to one another, in the direction of arrow 92.

Subsequently, the second holding component 64 slides with its second connecting component 84 on the first holding component 62 essentially parallel to the securing surfaces 68 in the direction of arrow 94 downwards, wherein the undercut sections 78, 88 extending at an acute angle to one another act as inclined insertion surfaces and make it easier for them to engage behind one another. Thus, the undercut sections 78 and 88 of the holding components 62 and 64 finally come to engage on one another and the two connecting components 72 and 84 engage behind one another over the entire longitudinal extension of the undercut sections 78 and 88. The holding connection of the two holding components 62 and 64 thus resulting can be subjected to considerable loads and so the article arranged on the second holding component 64 is held securely by the object bearing the first holding component 62.

To release the holding connection, the second holding component 64 can be moved upwards away from the first holding component 62 in the opposite direction to arrow 94 or moved away from the first holding component 62 at an angle upwards inclined in the direction of arrow 96 on account of the inclination of the undercut sections 78 and 88. In this respect, the mating surfaces 79, 89 determine, as a result of their inclination in relation to the securing surface 68 of the first holding component 62 as well as their angular position relative to one another, the inclination of the releasing movement 96 directed upwards at an angle, with which they can slide away from one another during release of the holding connection.

The inventive, automatic inclination of the releasing movement in relation to a surface normal of the securing surface 68 of the first holding component 62 leads to the fact that with the stipulated arrangement of the first holding component 62 on a vertically extending surface of the object the weight force counteracts any release of the holding connection. Thus any unintentional release and any undesired dropping down of an article held by the second holding component 64 is prevented.

In a preferred configuration, the angle of inclination of the releasing movement in the direction of arrow 96 is 35 to 70° in relation to the surface normal of the securing surface 68.

As a result of the arrangement of the undercut sections 78 and 88 on the connecting components 72 and 84 at their respective edges it is possible for the suspending movement in the direction of arrow 94 to deviate quite considerably from the releasing movement in the direction of arrow 96. However, a provision and release of the holding connection by means of a relative movement of the two holding components 62 and 64 relative to one another can be carried out in a direction which is in an angular range $\alpha$ which is limited by the releasing movement in the direction of arrow 96, on the one hand, and a movement extending contrary to the suspending direction 94, on the other hand. Accordingly, it is very easy to provide the holding connection since no exactly defined insertion direction need be met but rather the specified angular range $\alpha$ is available for the relative movement.

The inclined mating surfaces 79, 89 make it possible to release the holding connection by means of a releasing force directed at right angles to the securing surface 68 of the first holding component 62 and away from it and acting on the second holding component 64. The inclination results in a force component which extends in the direction 96 and leads to a corresponding releasing movement of the second holding component 64 in relation to the first 62. Thus, the secured article can be picked up by the customer by means of a force directed contrary to arrow 92, i.e. by means of a force directed away from the object, thereby terminating the holding connection of the two holding components 62, 64.

As for the rest, the same advantages result for the second embodiment of the device 60 as for the first.

Figure 5:
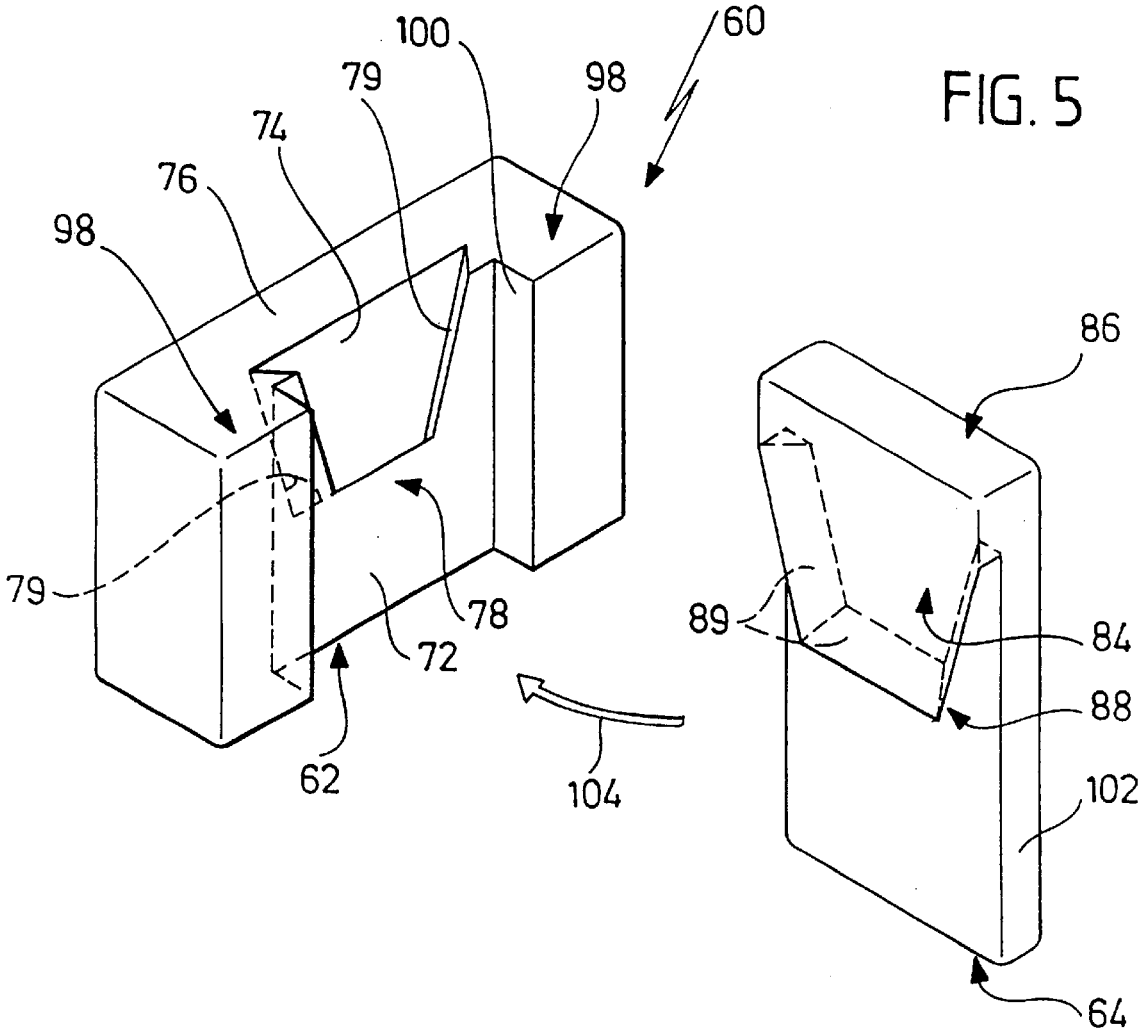
FIG. 5 a perspective view of a third embodiment of a securing device with separated holding components.

FIG. 5 shows a third embodiment which largely corresponds to the second embodiment described above and so the same reference numerals as for the second embodiment have been used and essentially only differences will be explained in the following.

In the third embodiment of the inventive device 60, the second connecting component 84 is formed on the second holding component 64 approximately in the shape of a plate, wherein the plane of the plate extends parallel to the securing surface which is not designated and thus parallel to the flat sides of the second holding component 64 in the shape of a parallelepiped, and is provided with a first, rectangular section, which adjoins the end face 86 and extends over the entire width of the flat side of the second holding component 64, and with an approximately trapezoidal section adjoining thereto. In this respect, the trapezoidal section adjoins the rectangular section with its side surface corresponding to the longer base side, and the side surfaces corresponding to the other sides of the trapezoid are designed as undercut sections 88 which form three mating surfaces 89 inclined in relation to the plane of the plate such that two of these run towards one another and the third mating surface 89 located therebetween has an edge parallel to the end face 86.

The recess 74 of the first connecting component 72 on the first holding component 62 is designed to correspond to the specified trapezoidal section of the second connecting component 84 so that the first connecting component 72 limits the recess 74 by means of three undercut sections 78 which form mating surfaces 79 extending approximately in the shape of a trapezoid and inclined to the flat side of the first holding component 62.

In the third embodiment, the narrow sides of the first holding component 62 adjacent to the end face 76 are adjoined by enlargement sections 98 which are each of an approximately parallelepiped design and form projecting side surfaces 100 adjoining the flat side of the first connecting component 72 facing away from the first holding component 62 at right angles.

These side surfaces 100 extend parallel to one another and have a distance from one another which extends beyond the width of the second holding component 64, i.e. the longitudinal extension of the end face 86, by a certain clearance so that when the holding connection is provided between the holding components 62 and 64 the latter can be inserted between the side surfaces 100 with its longitudinal sides 102 adjoining the end face 86. In order to provide the holding connection, the second holding component 64 is, in the embodiment illustrated in FIG. 5, first turned in accordance with arrow 104 before the two connecting components 72 and 84 are brought into engagement with one another, as already described for the second embodiment.

The guidance imparted by the side surfaces 100 and the longitudinal sides 102 when the second holding component 64 is brought closer to and inserted into the first holding component 62 facilitates the provision of the holding connection. In addition, this guidance forms, when the holding connection is established, a very good securing of the second holding component 64 against any rotation about an axis at right angles to the flat sides of the holding components 62, 64, i.e. about an axis at right angles to the securing surface 68 of the first holding component 62.

In contrast to the second embodiment, the inventive device 60 according to the third embodiment is designed such that when the holding connection is established the holding component 64 protrudes laterally beyond the first holding component 62 in the region of its end face 86 and its oppositely located end face which is not designated, wherein the first holding component 62 protrudes laterally beyond the second holding component 64 with its lateral enlargement sections 98 when the holding connection is established.

Apart from that, the device 60 according to the third embodiment according to FIG. 5 corresponds to the second embodiment according to FIGS. 3 and 4 as already described, wherein a corresponding handling and use are provided and the same advantages are obtained. In the illustration according to FIG. 5, the cable 66 obviously connecting the two holding components 62 and 64 has been omitted for reasons of simplification.

What is claimed is:

1. A device for mechanically securing an article against theft, comprising:

a first holding component with a securing surface for securing the holding component to an object, a second holding component for securing to said article, a cable connecting the two holding components, connecting components respectively associated with the holding components and having undercut sections for providing a releasable, form-locking holding connection of the two holding components, wherein at least one of the connecting components comprises an undercut section with a mating surface inclined in relation to the securing surface such that the holding connection is releasable by means of a releasing force acting at right angles to the securing surface, and securing means for securing the second holding component against rotation about an axis that is at a right angle to the securing surface of the first holding component.

2. A device as defined in claim 1, wherein the angle of inclination formed by the mating surface and the securing surface is in a range of about 25° to 60°.

3. A device as defined in claim 2, wherein the undercut sections are each arranged at edge regions of the connecting components, such that the holding connection is adapted to be provided by way of a relative movement of the holding components proceeding essentially parallel to the securing surface.

4. A device as defined in claim 1, wherein the undercut sections are each arranged at edge regions of the connecting components, such that the holding connection is adapted to be provided by way of a relative movement of the holding components proceeding essentially parallel to the securing surface.

5. A device as defined in claim 1, wherein one of the connecting components comprises two undercut mating surfaces, the planes of said surfaces having straight tracks in the plane of the securing surface, said tracks extending at an angle to one another.

6. A device as defined in claim 5, wherein the two mating surfaces are arranged in a V shape relative to one another.

7. A device as defined in claim 6, wherein the angle of intersection of the straight tracks is about 50° to 80°.

8. A device as defined in claim 5, wherein the angle of intersection of the straight tracks is about 50° to 80°.

9. A device as defined in claim 1, wherein said connecting components are formed as a single piece with their respective holding component.

10. A device as defined in claim 1, wherein the connecting components are substantially rigid.

11. A device as defined in claim 1, wherein:

the second holding component comprises a securing surface for securing to the article, and the securing surfaces of the two holding components are parallel and facing away from one another when the holding connection is provided.

12. A device as defined in claim 1, wherein the connecting components are designed such that the holding components are adapted to be locked with one another.

13. A device as defined in claim 12, wherein one connecting component comprises a resilient, undercut section.

14. A device as defined in claim 13, wherein one connecting component comprises edge sections engaging over the other connecting component on several sides with lateral clearance when the holding connection is provided.

15. A device as defined in claim 1 wherein one connecting component comprises edge sections engaging over the other connecting component on several sides with lateral clearance when the holding connection is provided.

* * * * *